United States Patent [19]

Szepesi

[11] Patent Number: 4,535,399

[45] Date of Patent: Aug. 13, 1985

[54] REGULATED SWITCHED POWER CIRCUIT WITH RESONANT LOAD

[75] Inventor: Tamas S. Szepesi, Eichenau, Fed. Rep. of Germany

[73] Assignee: National Semiconductor Corporation, Santa Clara, Calif.

[21] Appl. No.: 500,750

[22] Filed: Jun. 3, 1983

[51] Int. Cl.[3] ..... H02M 1/00

[52] U.S. Cl. ..... 363/41; 363/97; 363/134

[58] Field of Search ..... 363/20, 21, 40, 41, 363/95, 96, 97, 98, 17, 132, 133, 134, 24, 25, 26; 315/307, 308, 209 R, 216, 247, 287; 323/224

[56] References Cited

U.S. PATENT DOCUMENTS

| | | | |
|---|---|---|---|
| 4,071,812 | 1/1978 | Walker | 363/17 |
| 4,126,891 | 11/1978 | Suzuki et al. | 363/26 |
| 4,233,658 | 11/1980 | Lupatin et al. | 363/97 |
| 4,244,015 | 1/1981 | Beebe | 363/41 |
| 4,277,728 | 7/1981 | Stevens | 315/307 |
| 4,323,959 | 4/1982 | Check | 363/40 |
| 4,330,717 | 5/1982 | Coleman | 363/96 |
| 4,415,839 | 11/1983 | Lesea | 315/308 |

FOREIGN PATENT DOCUMENTS

| | | | |
|---|---|---|---|
| 2551150 | 11/1975 | Fed. Rep. of Germany | 363/97 |

*Primary Examiner*—Peter S. Wong
*Assistant Examiner*—Judson H. Jones
*Attorney, Agent, or Firm*—Gail W. Woodward; Paul J. Winters; Michael J. Pollock

[57] ABSTRACT

A switching circuit is employed to control the flow of energy from a power source to a tuned load. The control is achieved by means of a pulse width control voltage. The load current is sensed and fed to a phase locked loop which contains an oscillator producing an output that is slightly above load resonance. The phase locked loop forces the circuit to operate at a frequency where the modulating pulses are initiated at the load current zero crossing. The circuit is shown in use in a regulated d-c power supply and in a fluorescent lamp power supply application.

6 Claims, 7 Drawing Figures

REGULATED SWITCHED POWER CIRCUIT WITH RESONANT LOAD

BACKGROUND OF THE INVENTION

Tuned, or resonant, loads have been used in power electronics as a means of improving circuit efficiency and in reducing radiation at high frequencies. Switched power control elements are employed to apply energy to the loads and such elements will permit regulation of the power level. Regulation can be achieved by modulation of the power control stage supply voltage. Such voltage regulation is the best known and commonly employed method. However it requires expensive semiconductor power devices. Alternative methods of regulation can be achieved by the use of frequency modulation (FM) or pulse-width modulation (PWM) of the power control elements. However in most of the systems phase shift effects associated with off-resonance drives produce switching losses. Ideally if the switching devices are actuated at a zero current crossing such switching losses can be minimized but typically this only occurs for one set of control conditions.

SUMMARY OF THE INVENTION

It is an object of the invention to provide a tuned or resonant load with a switching drive in which FM is combined with PWM to control the flow of power so as to minimize switching losses.

It is a further object of the invention to sense the current in a resonant load driven from a PWM controlled switch and to employ a phase locked loop to generate a driving signal wherein the driving signal is phase adjusted for optimum switching performance and the PWM is employed to regulate the power flow.

These and other objects are achieved as follows. A power switch is employed to drive a resonant load from a d-c source whereby the d-c input is converted to an a-c drive. The power switch is pulse width modulated so as to control the power flow. The current flowing in the load is sensed and a sample coupled to the input of a PLL. The oscillator in the PLL, which is the signal source in the system, is thus phase locked to the load current. The PLL drives a pulse width modulator which also has an input that responds to a d-c control voltage. The modulator operates a driver circuit which provides the drive waveform suitable for operating the power switch. This combination produces a drive waveform to the load whereby the power switch is actuated at the load current zero crossing. This means that as the pulse width of the drive is varied the PLL output phase is automatically driven to compensate, so that the frequency of the VCO is changed.

If desired a rectifier filter combination can be coupled to the resonant load so as to produce a d-c power supply. In this case the supply can be regulated by coupling a portion of the d-c output to the pulse width modulator input through an error amplifier. In another application the resonant load is made up of a fluorescent lamp ballast and tube combination wherein one supply can power a plurality of lamps. The d-c input to the pulse width modulator can be employed for lamp starting programming and/or dimmer control.

DESCRIPTION OF THE INVENTION

Figure 1:
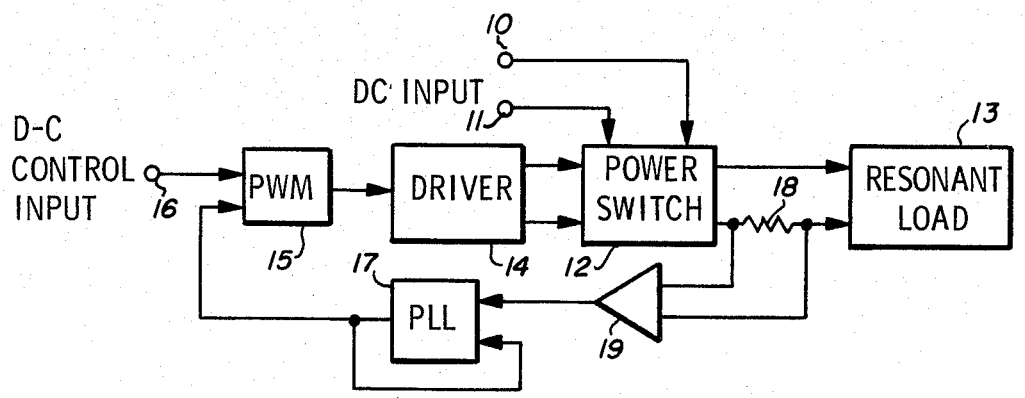
FIG. 1 is a block diagram of the basic arrangement of the invention.

FIG. 1 illustrates the basic concept of the invention. A d-c input is supplied to terminals 10 and 11. A power switch 12 controls the flow of energy from the input to a resonant load 13. While not shown separately load 13 includes a power dissipating element that absorbs the input energy. Typically power switch 12 converts the d-c input to a-c pulses at a frequency slightly above the load 13 resonant frequency. The energy flow is determined by the width of the applied pulses. These pulses are obtained via driver 14 and pulse width modulator 15. A pulse width control input is available at terminal 16. The basic pulse freqeuency of the circuit is set by the oscillator in PLL 17.

Since load 13 is resonant and driven by power switch 12 at close to its resonant frequency the current flowing is close to a sine wave. For example, a 100 kHz circuit can be pulsed at 125 kHz with high duty cycle to produce a quasi sine wave of current. Changing the pulse width through the d-c control input of the PWM would change the phase and amplitude of the load current monotonically. The circuit of the invention changes the operating frequency automatically so that the changing phase of the load current due to pulse-width modulation is always compensated by an opposite sign change of the phase shift of the tuned load. The compensation occurs as follows. Resistor 18 senses the load current and applies it as a sine wave voltage to shaper 19. The output of shaper 19 is a pulse train that is in phase with the load current and applied to one input to PLL 17. The other PLL input is obtained via line 20 from the PLL output. In the circuit shown, PLL 17 has an integrator-type loop filter and will adjust its output frequency until there is zero phase difference between the load current and the PLL 17 output.

The amount of energy fed to load 13 is controlled with a d-c potential applied to terminal 16. This means that a control potential can be employed to control the flow of a substantial quantity of power. Since the FM control of the operating frequency controls the phase of the load current the power switching can be made very efficient. In effect the power switching is made to turn on at the load current zero crossing. Since the control is obtained by way of a feedback loop this condition will be obtained for all pulse width conditions.

In prior art pulse width modulators it has been conventional to set the zero crossing condition for the maximum power state. This means that for any other pulse width condition, switching will not occur at the zero crossing and the switching efficiency is impaired.

Figure 2:
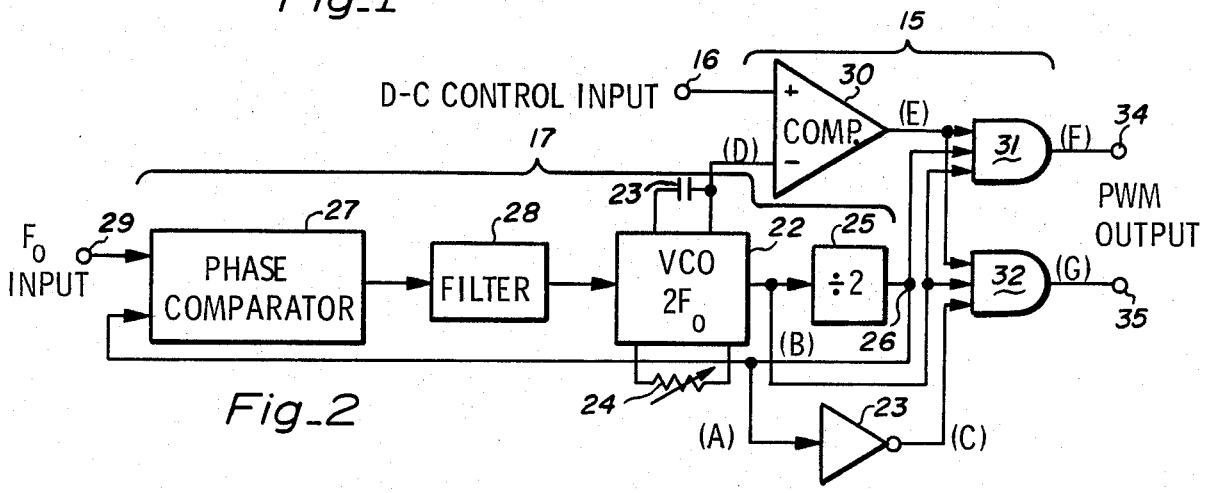
FIG. 2 is a block diagram of a pulse width modulator and PLL combination.

FIG. 2 is a logic diagram showing a combination of PLL 17 and PWM 15. The parenthetical letters refer to the waveforms of FIG. 3.

The heart of PLL 17 is a voltage controlled oscillator (VCO) 22. Its fundamental frequency is $2F_0$ or about twice the resonant frequency of load 13 (of FIG. 1).

Figure 3:
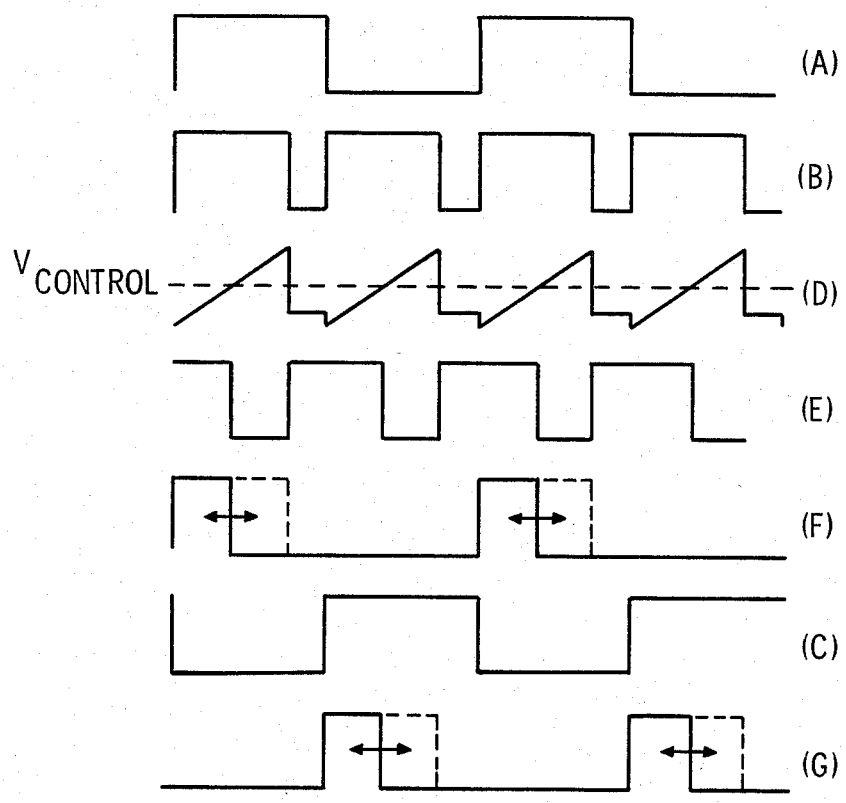
FIG. 3 is a graph showing the waveforms of FIG. 2.

Timing capacitor 23 of the VCO develops a sawtooth output, and a resistor 24 is included for symmetry control. That is, the sawtooth output can be made assymetrical as shown in FIG. 3. The output of VCO 22 is coupled to a divide by two counter 25 which provides the $F_0$ output of PLL 17 at node 26.

A memory type phase comparator 27 and integrator type low pass filter 28 complete PLL 17. These are conventional elements well known in the PLL art. Terminal 29 represents the input which operates at $F_0$ and, as shown in FIG. 1, receives a signal related to the resonant load 13 current from wave shaper 19.

PWM 15 includes a comparator 30 two AND gates 31 and 32 and a logic inverter 33. The sawtooth from capacitor 23 is coupled to the inverting input of comparator 30. This signal is shown as waveform (D) of FIG. 3. The d-c voltage on terminal 16 is shown a $V_{CONTROL}$. As shown in waveform (D) the sawtooth is assymetrical by virtue of resistor 24. Waveform (E) represents the output of comparator 30.

Comparator 30 switches when sawtooth (D) crosses the $V_{CONTROL}$ level at terminal 16. This is shown in waveform (E). Varying $V_{CONTROL}$ will vary the width of the pulse generated by the comparator. Since AND gate 31 is provided with input waveforms (A), (B), and (E), its output will be represented by (F) at terminal 34. This is a positive pulse of variable width. The dashed portion shows the widest available pulse. It can be seen from FIG. 3 that the pulse width limits are determined by the assymetry of VCO 22.

Due to inverter 33 the complement (C) of waveform (A) is fed to AND gate 32 along with waveforms (B) and (E). The output at terminal 35 is waveform (G). It can be seen that waveform (G) is also a positive pulse of variable width. It has a leading edge that occurs after the widest pulse trailing edge at terminal 34 and a trailing edge maximum that is just short of the leading edge of the positive pulse of waveform (F). Thus the output waveforms (F) and (G) can be used to alternately gate a power switch element with a suitable time delay between outputs at maximum pulse width so that the switch elements never conduct simultaneously. This can be important where bipolar transistors having significant storage time are employed. When power FET switches are used, the turn off delay is negligible a simpler circuit is applicable. The VCO is made to run at $F_0$ and the divider is omitted.

Figure 4:
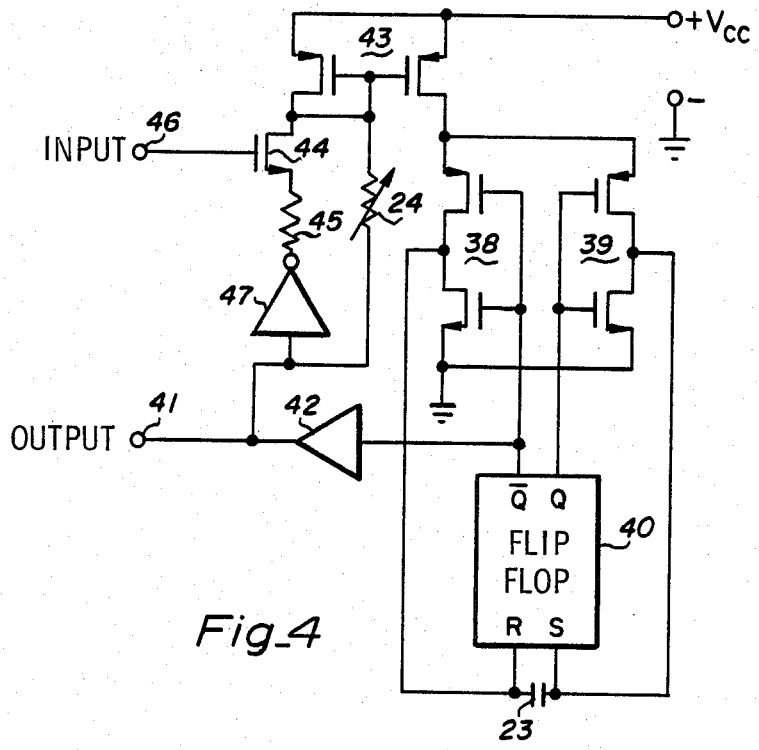
FIG. 4 is a schematic diagram of a CMOS VCO suitable for use in the FIG. 2 diagram.

FIG. 4 is a schematic diagram of a CMOS implementation of VCO 22 of FIG. 2. Two inverter gates 38 and 39 are coupled together and alternately switched by flip-flop 40. Capacitor 23 which is coupled between the inverter gate outputs is the main VCO frequency determining element. Terminal 41 is driven via buffer 42 from the $\overline{Q}$ output of flip-flop 40. When $\overline{Q}$ is low the right hand plate of capacitor 30 will be pulled down to ground by inverter 39 and the capacitor will be charged by current flowing in the upper element of inverter 38. The charging current determined by the value of resistor 24 which sets a current that will be reflected via current mirror 43. In this state, inverter 47 will turn transistor 44 off. When the voltage rises to the flip-flop 40 reset level the circuit will switch Q will go low and $\overline{Q}$ will go high. This will discharge capacitor 23 and charge it to the opposite polarity. Capacitor 23 will then have its right hand plate pulled up by inverter 39 and its left hand plate will be pulled close to ground by inverter 38. However with $\overline{Q}$ high the current in resistor 24 is interrupted and the charging current through resistor 45 enabled by inverter 47. The current charging capacitor 23 in this direction is controlled by the conduction in transistor 44 (and resistor 45). This charge direction will be continued until the set level of flip-flop 40 is reached whereupon the oscillatory cycle will repeat. The current in transistor 44 is set by the d-c input voltage on terminal 46. Therefore the current reflected by mirror 43 and the charging time for capacitor 23 will be a function of the input voltage. Resistor 45 is present to limit the maximum current that can flow in transistor 44.

Figure 5:
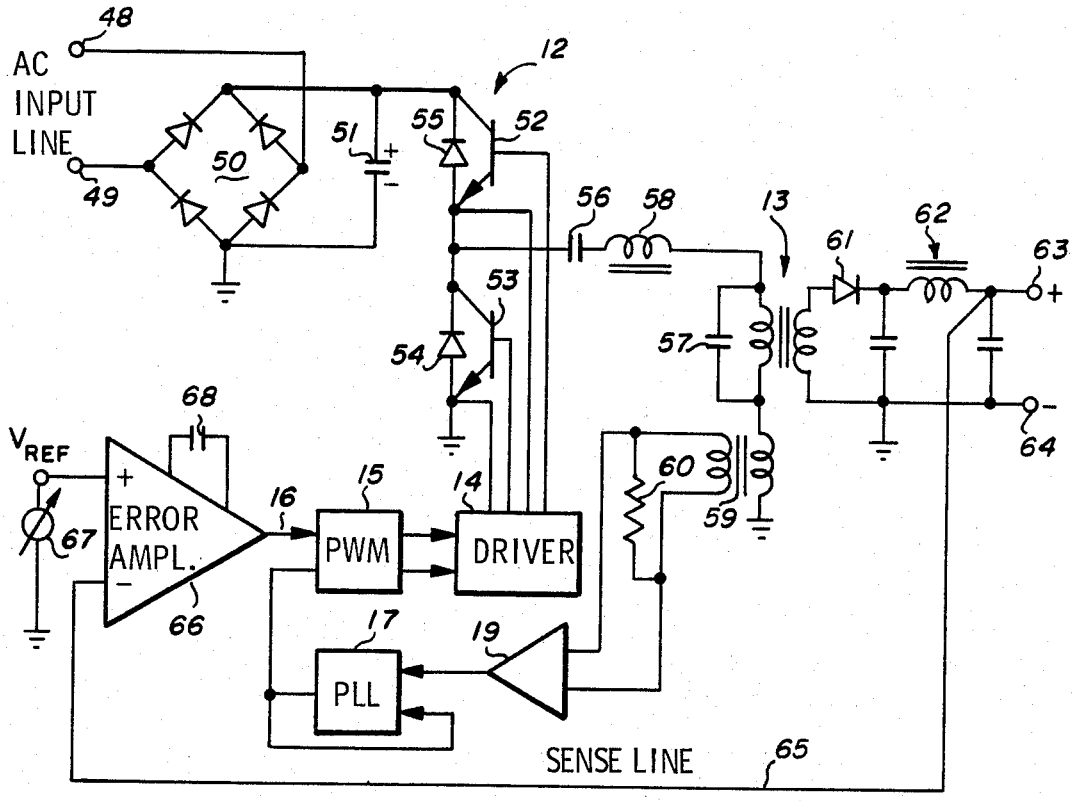
FIG. 5 is a combination schematic and block diagram of a regulated DC/DC converter with resonant load.

FIG. 5 shows the invention applied to a regulated DC/DC converter. The components are similar to those illustrated in FIG. 1 except that some further circuit details are shown. Terminals 48 and 49 represent the a-c mains or the a-c power input line. This could be a 120 volt RMS supply. Bridge rectifier 50 converts the a-c input to pulsating d-c which is partially filtered by buffer capacitor 51. Thus a peak rectified voltage appears across capacitor 51 which has a substantial ripple component at 120 Hz.

Power transistors 52 and 53 are alternately driven conductive by driver 14 which is constructed conventionally so that its two pulse outputs are galvanically isolated. This means that the pulses driving the transistor bases are referenced to the related emitter. Thus waveforms (F) and (G) of FIG. 3 act to alternately drive transistors 52 and 53.

Each power transistor has a parallel connected diode (54 and 55) which is poled to conduct current in the opposite direction and thus provide reverse current sinking. Thus the input to capacitor 56 is alternately grounded and then switched to the full voltage of capacitor 51. This provides a pulsating current drive. Capacitor 56 blocks the d-c input so that only a-c flows in transformer 13. When transistor 52 is on, capacitor 56 is charged toward the potential across capacitor 51. Thus, current will flow downward through transformer 13. When transistor 52 is turned off, diode 54 will conduct the load current. Then when transistor 53 is turned on (after transistor 52 is turned off) capacitor 56 will discharge so that current will flow upward through transformer 13. Then when transistor 53 is turned off, diode 55 will conduct the load current. In effect transistors 52 and 53 apply an alternating potential to transformer 13 via capacitor 56 and the amount of power coupled is a function of the transistor on duration.

Capacitor 57 and inductor 58 act to tune the load circuit to a frequency which is slightly below the signal frequency developed in PLL 17. Current transformer 59 responds to the tuned load current and applies a signal to wave shaper 19. Resistor 60 loads current transformer 59 so that its output is a voltage that is in phase with the tuned load current.

It is to be understood that tuned load includes transformer 13 which couples energy to rectifier 61, filter 62 and any d-c load connected between terminals 63 and 64.

Transformer 13, while shown as a conventional transformer, could be of the auto transformer form of construction. Since transformer 13 can be operated at a frequency that is quite high relative to the power frequency at terminals 48 and 49, the d-c output is well filtered using relatively small inexpensive components. In a conventional off-line power supply the transformer and filter components must be relatively large and therefore quite heavy and expensive.

The d-c output at terminal 63 is transferred via sense line 65 to error amplifier 66 which in turn operates PWM 15 as described above. The error amplifier is poled so that the potential on the sense line 65 will be regulated by virtue of the pulse width modulation. It can be seen that as the output rises the PWM will narrow the pulses to driver 14 so that less energy is fed to transformer 13. When the output voltage falls the input to PWM 15 will rise so that the pulses applied to the switches are widened and more energy is fed to transformer 13. Error amplifier 66 is provided with a reference input 67 which provides an adjustment for the output voltage at terminal 63.

Capacitor 68 is the frequency compensating element of the negative feedback control loop. Its function is to roll off the gain of error amplifier 66 with frequency so that the system is stable.

Figure 6:
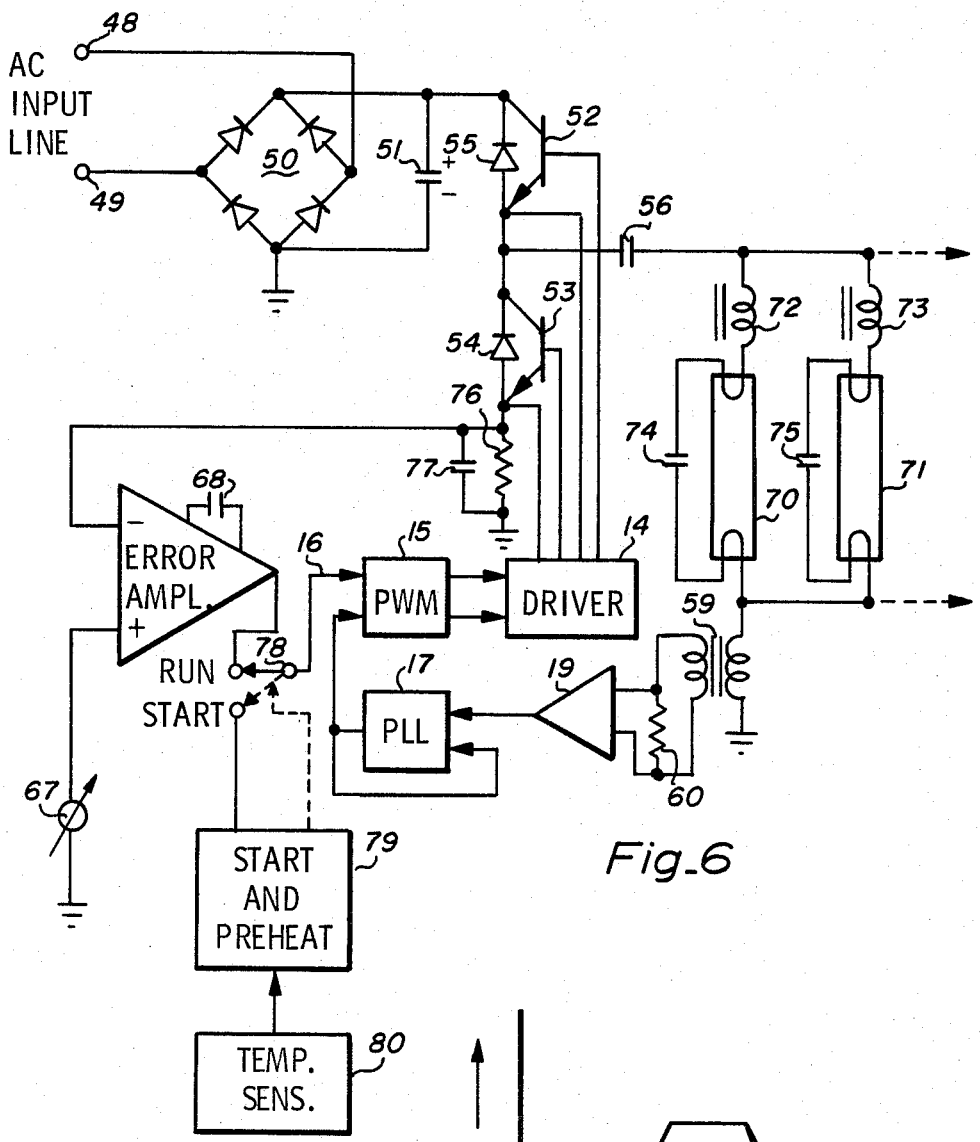
FIG. 6 is a combination schematic and block diagram of a fluorescent lamp driver with resonant load.

FIG. 6 shows an alternative resonant load switching application. Here a fluorescent lamp exciter is shown. Where the parts are the same as those of FIG. 5 the same numbers are used. The input line terminals 48 and 49; bridge rectifier 50; buffer capacitor 51; switches 52 and 53; reverse diodes 54 and 55; and d-c blocking capacitor 56 are all the same. Also switch driver 14, PWM 15 and PLL 17 along with the wave shaper 19 and current tranformer 58 are the same.

Two fluorescent lamp tubes 70 and 71 are shown and is to be understood that others could be connected as shown by the dashed line extensions. Inductors 72 and 73 are coupled in series with the lamps and are driven in parallel by coupling capacitor 56. Capacitors 74 and 75 which are coupled by way of the lamp filaments act to resonate the series inductors. Transformer 58 has a primary that senses the total load current. Resistor 76 and parallel capacitor 77 develop a d-c potential that is related to the power flowing into the circuit from the line. This potential is applied to error amplifier 63 so as to regulate the d-c control input of PWM 15 when switch 78 is in the run position. Thus as the potential on sense line 62 rises the pulse width modulation will produce narrower pulses to reduce the power fed to the resonant load. As the potential on sense line 62 falls the pulse width modulation will widen the pulses to increase the power. Thus it can be seen that the input power of the circuit is regulated and is controlled by the d-c potential at the non-inverting input of error amplifier 66. If the losses on the switching elements and other parts of the control circuit are low, as is the case here, this practically means the regulation at the power on the load, or as is the case here, on the lamps. If the DC input voltage of the circuit on capacitor 51 is stabilized with an additional voltage stabilizer, the lamp power is stabilized also against mains variations.

Switch 78 is present so that the automatic control loop can be broken and the lamp current controlled by a separate program. When switch 78 is in the start position, the error amplifier control is disconnected and the control voltage applied to PWM 15 is developed in a circuit inside block 79.

Figure 7:
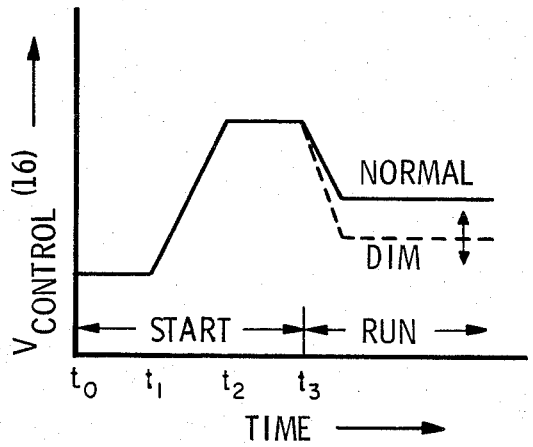
FIG. 7 is a graph showing the programming of the FIG. 6 circuit.

FIG. 7 is a graph of a preferred program for fluorescent lamp control. It shows the desired PWM control voltage versus time for extending lamp life. The start and preheat circuit 79 actuates the switch 78 and an automatic sequence established. First a preheat cycle is run from $t_0$ to $t_1$. During this interval the lamps are operated on a low level of filament current to precondition them prior to starting. This interval is most important in at low temperatures. Then between $t_1$ and $t_2$ the lamp current is ramped up for a soft start to a higher than normal level. Then over the interval $t_2$–$t_3$. The lamps are ignited. After $t_3$ the lamp current is reduced to the normal run condition. After starting switch 78 is returned to its run position where control 67 provides a varaible voltage for light intensity control or dimming. This is shown in the dashed portion of the curve of FIG. 7. Temperature sensor 80 can be employed to sense the ambient temperature and modify the starting conditions between $t_0$ and $t_2$ accordingly. In this case, at low temperatures the preheat interval $t_0$ and $t_1$ can be lengthened.

The invention has been shown and applications detailed. When a person skilled in the art reads the foregoing description, alternatives and equivalents, within the spirit and intent of the invention, will become apparent. Accordingly, it is intended that the scope of the invention is limited only by the following claims.

I claim:

1. A circuit for controlling a substantial power output with a d-c control potential, said circuit comprising:

a resonant load in which a tuned circuit provides a quasi sine shaped current wave form in a power dissipating element;

a source of d-c input power;

switching means coupled between said source of input power and said resonant load whereby said load is supplied with current pulses at a rate that is slightly in excess of the resonant frequency of said resonant load;

means for modulating the width of said pulses to vary the power transferred into said resonant load;

a phase locked loop having an internal oscillator coupled to a divide by two buffer whereby said oscillator is operated at two times the desired frequency and produces asymmetrical output signals that includes a sawtooth output and a pulse output, a memory type phase comparator, an integrator type loop filter, an output, and a pair of inputs one of which is coupled to said output whereby the frequency of said oscillator is varied until the output phase matches the phase of the signal fed to the other of said pair of inputs;

means for sensing the current flowing in said resonant load;

means for shaping the signal provided by said means for sensing to develop a pulse signal in phase with said quasi sine wave load current;

means for applying the shaped signal to said other of said pair of inputs of said phase locked loop;

a high gain comparator having one input coupled to receive said sawtooth oscillator output and the other input coupled to receive a d-c control voltage with the comparator output being a pulse of variable width as determined by said d-c control voltage; and means for feeding said comparator output to one input each of first and second three input AND gates, means for feeding the output of said divide by two buffer to the second input of said first AND gate and its complement to said second input of said second AND gate, and means for feeding the pulse output of said oscillator to each of the third imputs of said first and second three input AND gates whereby said AND gates develop alternating output pulses having widths determined by said d-c control voltage.

2. The circuit of claim 1 wherein said resonant load includes a transformer that energizes a rectifier and filter combination to produce a d-c output voltage.

3. The circuit of claim 2 wherein a portion of said d-c output voltage is fed to the inverting input of a high gain differential error amplifier the output of which is coupled to provide said d-c control and the noninverting input is connected to a source of variable voltage whereby said d-c output is regulated by said circuit and controlled by said source of variable voltage.

4. The circuit of claim 1 wherein said resonant load includes a combination of at least one fluorescent lamp, series ballast inductor and shunt capacitor combination whereby the power coupled to said combination is controlled by said d-c control voltage.

5. The circut of claim 4 wherein said switching means includes a current sensing means for developing a d-c potential related to the power fed to said combination and a high gain error amplifier is employed to couple the difference between said d-c potential and a reference voltage to said comparator whereby said power is regulated.

6. The circuit of claim 4 wherein said d-c control voltage is programmed to provide power proportional dimming of said fluorescent lamp.

* * * * *